United States Patent [19]

Ostertag

[11] Patent Number: 4,947,668

[45] Date of Patent: Aug. 14, 1990

[54] ROLLING MILLING TOOL

[75] Inventor: Alfred Ostertag, Celle, Fed. Rep. of Germany

[73] Assignee: Wilhelm Hegenscheidt GmbH, Erkelenz, Fed. Rep. of Germany

[21] Appl. No.: 364,691

[22] Filed: Jun. 8, 1989

[30] Foreign Application Priority Data

Aug. 2, 1988 [DE] Fed. Rep. of Germany ..... 8809823
Jan. 10, 1989 [EP] European Pat. Off. ..... 89100291.7

[51] Int. Cl.[5] ..... B21B 27/10; B24B 39/02; B24B 39/04

[52] U.S. Cl. ..... 72/75; 72/67; 72/77; 29/90.01

[58] Field of Search ..... 72/67, 75, 80, 84, 77; 29/90.01

[56] References Cited

U.S. PATENT DOCUMENTS

| | | | |
|---|---|---|---|
| 1,499,533 | 7/1924 | Katzenmeyer | 72/75 |
| 2,048,598 | 7/1936 | Christiansen | 72/75 |
| 2,247,887 | 7/1941 | Nascimbeni | 29/90.01 |
| 2,575,938 | 11/1951 | Brenneke | 72/75 |
| 3,066,557 | 12/1962 | Stevens | 72/75 |
| 3,911,707 | 10/1975 | Minakov et al. | 72/75 |

FOREIGN PATENT DOCUMENTS

| | | | |
|---|---|---|---|
| 644268 | 4/1937 | Fed. Rep. of Germany . | |
| 8802635 | 6/1988 | Fed. Rep. of Germany . | |
| 512043 | 4/1976 | U.S.S.R. | 29/90.01 |
| 1009731 | 4/1983 | U.S.S.R. | 72/75 |
| 1063582 | 12/1983 | U.S.S.R. | 72/75 |
| 1416297 | 8/1988 | U.S.S.R. | 72/75 |

*Primary Examiner*—Robert L. Spruill
*Attorney, Agent, or Firm*—W. G. Fasse; D. H. Kane, Jr.

[57] ABSTRACT

A rolling milling tool is constructed so that the roller, in the form of a sphere, or cylinder or cone, is supported in a hydrostatic bearing to avoid counter rollers, thereby reducing the size of such tools. The roller is held in a bearing socket or guide chamber which may provide for an axial play of the roller in the chamber. The bearing socket or guide chamber is formed in a roller head which may be itself constructed for being chucked in a tool holder, or the roller head may be received in a housing which is held in a tool holder of a machine tool, such as a lathe. Ducts connect the hydrostatic bearing to a source of fluid pressure. The tool is suitable for a smooth rolling and/or work hardening roller operation.

27 Claims, 13 Drawing Sheets

FIG.14
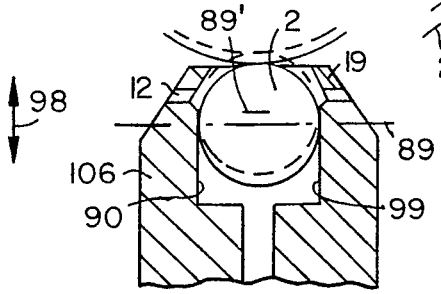
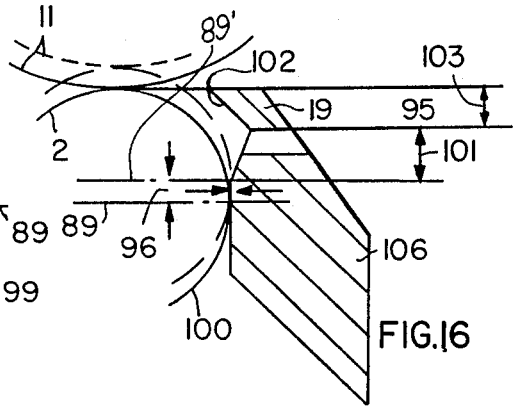
FIG.16
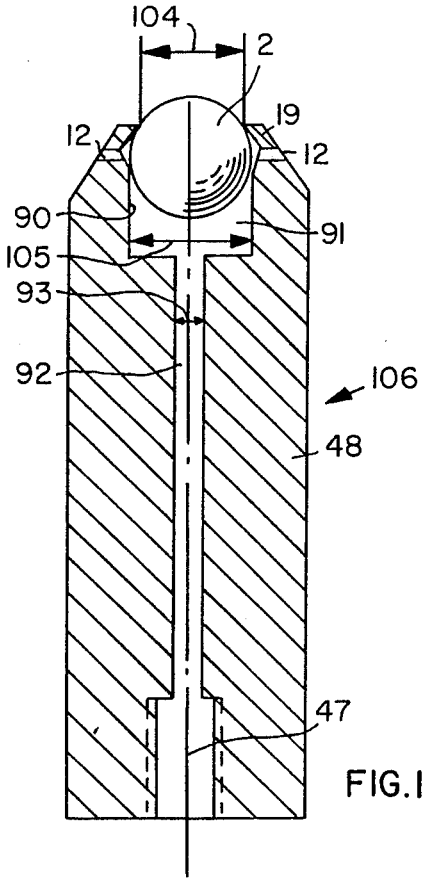
FIG.13
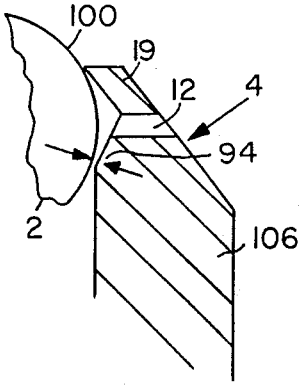
FIG.15

ROLLING MILLING TOOL

CROSS-REFERENCE TO RELATED APPLICATION

The present application relates to U.S. Ser. No.: 07/401,971, filed on July 27, 1989, and entitled: ROLLER MILLING TOOL UNIT FOR A MILLING MACHINE TOOL; now U.S. Pat. No. 4,922,739.

1. FIELD OF THE INVENTION

The invention relates to burnishing and deep a rolling tool having at least one roller hereafter referred to as milling roller rotatably mounted in a roller head which also guides and supports the milling roller. The tool is suitable for a roller burnishing operation hereafter referred to as smooth rolling operation and/or for a deep rolling operation.

2 BACKGROUND INFORMATION

Milling rollers of this type can take various forms, for example, these rollers can be spherical, conical, or cylindrical. Where the milling roller is a cylinder or a cone, it may be mounted to be adjustable through a tilting angle for positioning the longitudinal rotational axis of the roller. An adjustment of the tilting angle may also be accomplished by tilting the entire roller head which forms a mounting for the milling roller.

Tools of the above type are known primarily as reliable roller burnishing tools used, for example, on center-type lathe machines for the smooth rolling of turned work pieces. Such tools are manually mounted on the machine support by the operator as needed and removed again when the smooth rolling operation is completed since the available space on the support is limited. These tools are large and comprise a relatively large number of individual components. Additionally, these conventional milling rollers are expensive to manufacture.

An improved burnishing and deep rolling tool of the above type is disclosed in German Utility Model No. (DE-Gbm) 8,802,635. This known tool is rather compact compared to similar previous tools and it uses fewer and simpler components.

For performing a smooth rolling operation, it is usually desirable that the diameter of the milling roller which contacts the work piece is as small as possible. This feature reduces the absolutely required rolling forces However, a small roller diameter requires supporting rollers that in turn must be mounted in roller bearings requiring for their support space in the roller head. As a result, the structural efforts for mounting and supporting the milling rollers are still rather substantial and the structural dimensions of the roller head are still determined by the size and number of the required supporting rollers and their roller bearings.

Additionally, it is disadvantageous to contact a rotating work piece with the milling roller of such a conventional tool because a substantial initial slip results immediately following the just mentioned contact between the milling roller and the rotating work piece due to the inertia of the support rollers. This slip occurs between the milling roller and the support rollers on the one hand and between the milling roller and the work piece on the other hand during the acceleration of the milling roller. Such slip is undesirable because it generates substantial heat.

German Patent Publication No. 644,268 discloses a roller polishing or burnishing arrangement comprising a plurality of rollers each mounted on a mechanical axle carried by a respective piston cylinder. All the piston cylinders are pressurized by a common pressure line so that all the rollers maintain a uniform rolling pressure on a rotating work piece regardless of the non-roundness of the work piece.

U.S. Pat. No. 3,066,557 discloses a ball-type upsetting apparatus, comprising a drawbar carrying one or more upsetting balls in respective hemispherical recesses. An axial bored hole passes through the drawbar and communicates with a radial passage leading to each hemispherical recess. Lubricating oil is supplied through the axial hole and the radial passages to lubricate the upsetting balls.

OBJECTS OF THE INVENTION

In view of the foregoing, it is the aim of the invention to achieve the following objects singly or in combination:

to construct a tool of the type described above that is substantially reduced in its structural size, especially with regard to the roller head;

to eliminate support rollers altogether to thereby also avoid the adverse influence caused by their mass inertia;

to mount a milling roller in a roller head in such a way that the required rolling pressure can be applied by a pressurized fluid; and to construct the tool in such a way that the above mentioned slip and Hertzian stress are avoided or eliminated.

SUMMARY OF THE INVENTION

The above objects have been achieved according to the invention by a milling roller which is mounted in a roller head in a hydrostatic bearing, wherein the roller head is equipped with an inlet channel for connection to a source of a fluid under pressure. As a result, the invention altogether avoids the support rollers and respective roller bearings that were unavoidably necessary heretofore.

The features of the invention make it possible to construct the roller head substantially smaller than conventional roller heads. Additionally, the mass inertia of the support rollers and of the roller bearings has been eliminated since these components have been eliminated. Yet, another advantage of the invention is seen in that the diameter of the milling roller may be smaller than heretofore so that the required absolute rolling forces have been further reduced, compared to the prior art. Smaller absolute rolling forces in turn make it possible to further reduce the structural dimensions of the rolling head. A further advantage of the hydrostatic bearing for a milling roller is seen in the fact that the Hertzian stress between the milling roller and the support roller has been avoided which in turn avoids so-called pitting completely. As a result, the useful working life of the structural components according to the invention is increased. In fact, it is even possible to make the milling rollers of ceramic materials such as oxide ceramic materials, metal ceramic materials, carbide ceramic materials, and so forth. Such milling rollers make it possible to burnish even work pieces of hardened material or those having hardened surfaces. Additionally, the service time of such ceramic milling rollers is substantially better than other types of rollers so that the economy of the present tools has also been improved compared to conventional tools.

BRIEF DESCRIPTION OF THE DRAWINGS

In order that the invention may be clearly understood, it will now described by way of example, with reference to the accompanying drawings, wherein:

FIG. 13 shows a longitudinal section through a roller head;

FIG. 14 shows a portion of FIG. 13, however, with the roller in its working position;

FIGS. 15 and 16 show enlarged portions of FIG. 14 with the milling roller in differing positions;

DETAILED DESCRIPTION OF PREFERRED EXAMPLE EMBODIMENTS AND OF THE BEST MODE OF THE INVENTION

Figure 1:
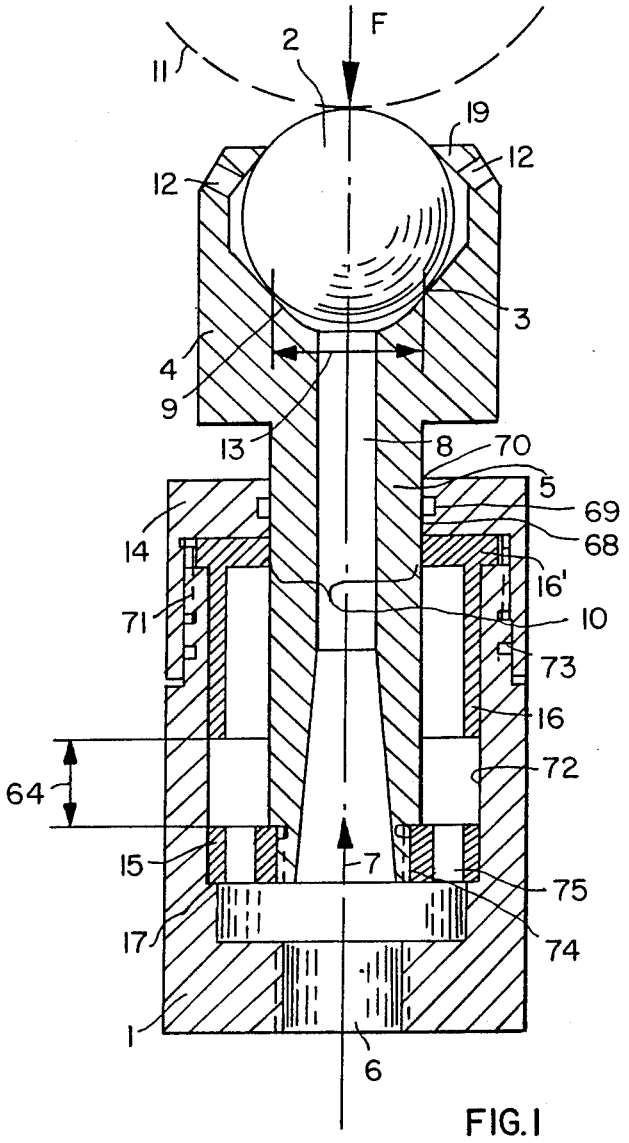
FIG. 1 is a longitudinal axial section through a burnishing and deep rolling tool according to the invention showing the basic components of the tool combining a hydrostatic bearing with a milling roller.
Figure 2:
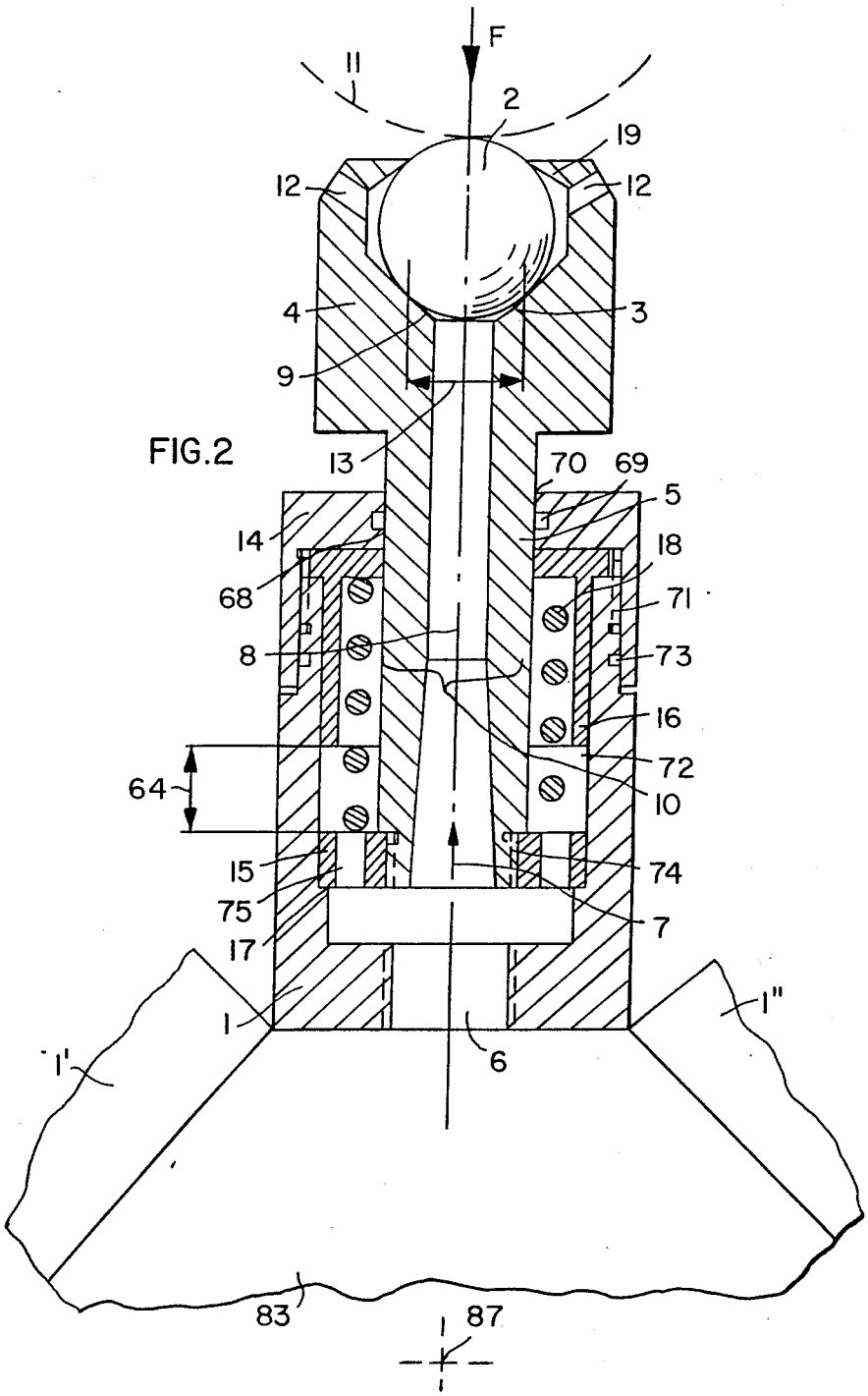
FIG. 2 is a sectional view similar to that of FIG. 1, however, showing a reset spring and the arrangement of a multiple shaft.

FIGS. 1 and 2 show a burnishing and deep rolling tool, for example for smooth rolling of turned work piece surfaces, preferably of cylindrical outer work piece surfaces. The roller head of the tool comprises a housing 1 which can be chucked in a work piece support not shown, but conventionally provided, for example, in a lathe including a lathe of the numerically controlled type. The roller head with its housing can also be chucked in a revolving tool carrier head of a center lathe. A milling roller 2 is mounted in a hydrostatic bearing 3 formed in the roller head 4. The roller head 4 is received in its housing 1 as will be described in more detail below. The roller head 4 has a rim 19 for retaining the roller 2 within the hydrostatic bearing 3. In operation, the roller 2 is pressed against the surface to be smoothed. This surface is a cylindrical surface of a work piece 11 shown in dashed lines. The force F is exerted on the work piece surface during the rolling operation. The rolling force F is taken up by the roller head 4 and transmitted through a plunger 5 which is guided in the housing 1 and in the respective housing cover 14. An O-ring 69 surrounding the bore 68 in the cover 14 seals the ring gap 70 between the plunger 5 and the cover 14.

The rolling force F is produced by the fluid under pressure indicated by the arrow 7 entering into the port 6 of the housing 1. The port 6 is connected to a source of fluid pressure not shown. The fluid under pressure flows through the channel 8 into the hydrostatic bearing 3 to form a pressure cushion between the bearing seat or shell 9 in the roller head 4 and the milling roller 2. As mentioned, the roller 2 does not necessarily have to be a roller. The roller 2 could even be spherical.

The cross-sectional area of the plunger 5 facing downwardly is exposed to the fluid pressure simultaneously with the exposure of the roller 2. As a result, the roller head 4 and its plunger 5 are moved in the direction indicated by the arrow 7 against the work piece 11, thereby pressing the milling roller 2 against the surface of the work piece 11 for performing the smooth rolling operation under compressive forces determined by the fluid pressure and the surfaces involved. The fluid flows through the tool and a static flow is established. The roller head 4 is provided with exit ports 12 below the retaining rim 19 so that the pressurized fluid can pass through these exit ports 12 out of the bearing 3 for use as a lubricant in the rolling operation. The rolling force F is determined by the fluid pressure effective on the surface 13 of the milling roller 2. As soon as the milling roller 2 contacts the work piece 11 under pressure, an equilibrium of forces is established because the surface 13 of the milling roller 2 is equal in size to the plunger surface 10 exposed to the pressure 7.

The above mentioned seal 69, for example, an O-ring prevents the escape of the pressurized hydraulic fluid through any ring gap 70. The cover 14 has an internal threading 71 securing the cover 14 to the housing 1. An O-ring 73 seals any gap between the housing 1 and the cover 14. A stop bushing 16 is held in place with its top flange 16′ clamped between the upper rim of the housing 1 and the cover 14. The lower downwardly facing shoulder of the bushing 16 provides a stop for a guide piston 15 which is secured to the lower end of the plunger 5, for example, by a threading 74 and which is guided by the inner cylinder surface 72 in the housing 1. Thus, the plunger 5 is guided in the cover 14 and in the housing 1 to prevent any tilting of the plunger 5 relative to the housing 1. The downwardly facing shoulder of the bushing 16 limits the upward stroke of the plunger 5. The housing 1 is provided with a further upwardly facing shoulder 17 having a reduced diameter relative to the diameter of the guide bore 72, thereby providing a downward limit to the stroke of the plunger 5. Fluid under pressure can enter into the space within the guide bore 72 through bores 75 in the guide piston 15. The vertical length of the displacement stroke is shown at 64.

The embodiment of FIG. 2 is substantially the same as that of FIG. 1. However, in FIG. 2, a reset spring 18 is arranged in the guide chamber between the stop bushing 16 and the guide piston 15. The reset spring 18 is biased between the bushing 16 and the guide piston 15. The spring 18 tends to bias the plunger 5 and the roller head 4 into the starting position shown in FIG. 2 in which the guide piston 15 rests against the shoulder 17. When the reset spring 18 is used, the surface area 10 of the plunger cross-section is larger than the surface area 13 of the hydrostatic bearing 3 so that again the sum of all effective forces is zero or rather these forces are in equilibrium.

The milling roller 2 has sufficient play in the hydrostatic bearing 3 in the direction toward the work piece 11 so that when the pressure cushion has been established, the milling roller 2 is not bearing against the retaining rim 19, but bears against the surface of the work piece 11. As shown in FIG. 2, the housing 1 may itself be secured to a clamping chuck shaft 83 which may be capable of carrying a plurality of housings 1, 1', 1". Housings 1', 1" are shown schematically in FIG. 2. The clamping chuck shaft 83 may be rotatable about the axis 87 extending perpendicularly to the plane of the drawing sheet.

Figure 3:
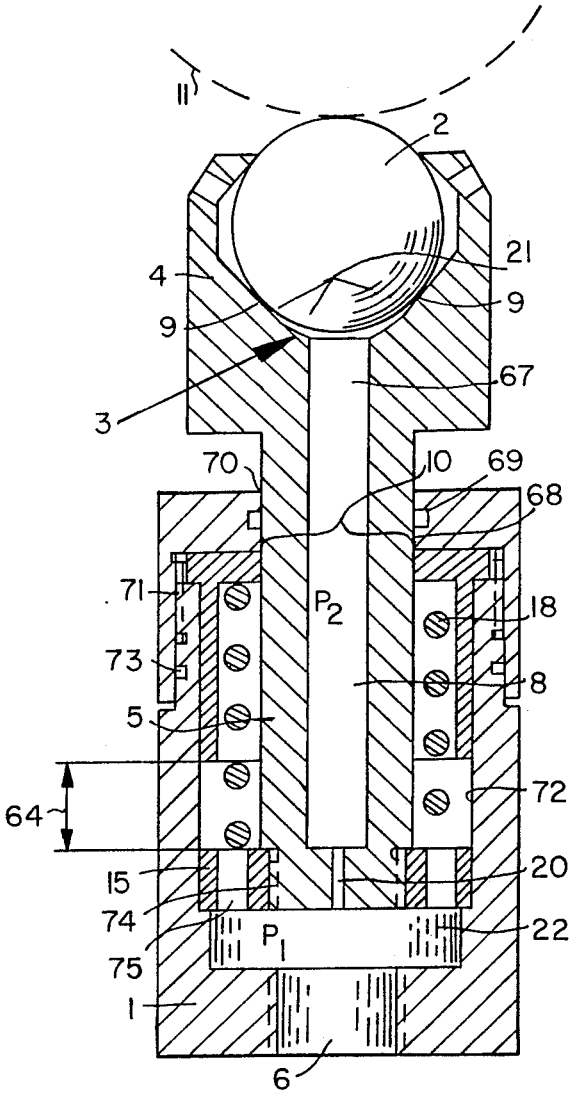
FIG. 3 is a view similar to that of FIGS. 1 or 2, however, illustrating a throttling channel for controlling the pressure in the hydrostatic bearing.

FIG. 3 illustrates a burnishing and deep rolling tool in which the lower end of the plunger 5 is closed, except for a throttling bore 20 connecting the channel 8 with the hydraulic fluid supply through inlet port 6. A further throttling effect is provided at 21 where the milling roller 2 bears against its seat 9 in the hydrostatic bearing 3. These throttling devices 20 and 21 influence the pressure. More specifically, the throttling bore 20 reduces the entrance pressure P1 in the chamber 22 below the guide piston 15 to the pressure P2 in the channel 8. Thus, the pressure P2 is available for producing the rolling force. Since the pressure P1 is higher than the pressure P2 an excess force is effective on the plunger 5, thereby making it possible to use the reset spring 18. It is possible to make the plunger cross-sectional surface equal to or even smaller or larger than the surface area 13 on the milling roller 2. It is merely necessary to dimension the spring 18 in such a way that the sum of all effective forces is again zero. The reset spring 18 should have a relatively flat spring characteristic.

Figure 4:
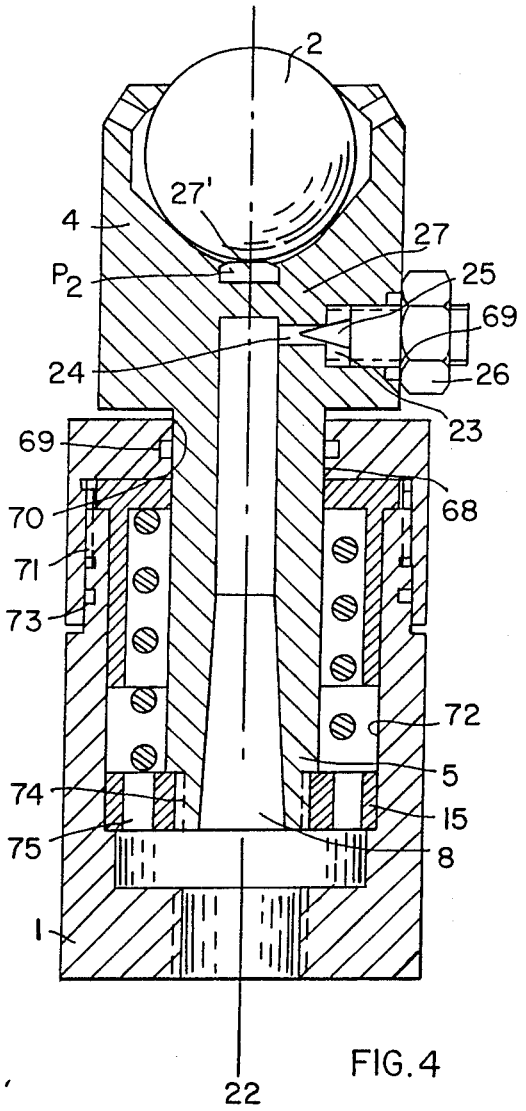
FIG. 4 is a view similar to that of FIG. 3, however illustrating an adjustable throttle device.

FIG. 4 illustrates an embodiment wherein an adjustable throttling device 23 is employed for adjusting or determining the pressure P2. The adjustable throttling device 23 is held in a threaded bore in the roller head 4 between a bore 24 out of the channel 8 and a passage 27 connecting the throttling device 23 to a chamber 27' below the milling roller 2 for establishing the pressure P2. The cross-section between the bore 24 and the passage 27 is either enlarged or reduced by a throttling needle 25 forming part of a threaded member of the throttling device 23 received in the threaded portion of the bore 24. The tip of the throttle needle 25 reaches into the reduced diameter portion of the bore 24, thereby limiting the free cross-sectional area of the bore 24. For adjusting the desired pressure P2 the counter nut 26 is loosened and the throttling device adjusted into the desired position by rotating the throttling device 23. After adjustment the counter nut 26 is tightened again. A sealing ring 69 is inserted in the roller head 4 to surround the threaded portion of the throttling device 23, whereby the counter nut 26 presses the sealing ring 69 into its sealing position to seal the throttling needle 25, or rather the throttling device 23 against leakage.

Figure 5:
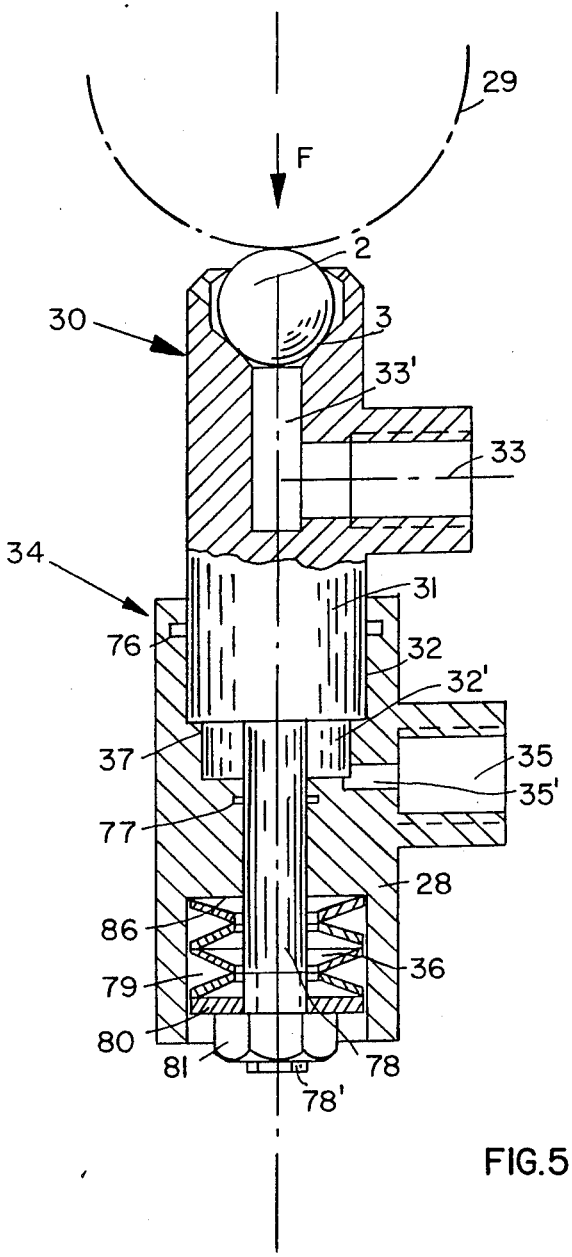
FIG. 5 is a longitudinal section through a modified embodiment of a burnishing and deep rolling tool according to the invention.

FIG. 5 also illustrates a burnishing and deep rolling tool for the smooth rolling of work piece surfaces 29. The tool has a housing 28 by means of which the tool can be held in a chuck or a so-called revolver head of a machine tool not shown, such as a numerically controlled lathe or a center lathe. The milling roller 2 is again supported in a hydrostatic bearing 3 as described above, whereby a retaining rim around the upper edge of the roller head 30 prevents the roller 2 from falling out of its hydrostatic bearing socket. The milling roller 2 is pressed against the surface 29 by the rolling force F. This rolling force F is taken up by the roller head 30 having a lower piston end 31 opposite the milling roller 2. The piston end 31 is received in the cylinder bore 32 of the housing 28. Fluid under pressure is supplied to the hydrostatic bearing 3 through an inlet port 33 and a channel 33' in the roller head 30. A chamber 32' below the cylinder bore 32 receives fluid under pressure through the inlet port 35 and the duct 35'. The chamber 32' has a diameter somewhat smaller than the diameter of the cylinder chamber 32 to form a shoulder 37 providing a lower limit stop against the downward displacement of the piston end 31 of the roller head 30. An O-ring 76 seals the upper end 34 of the housing 28 against the lower piston end 31. A further seal 77 is provided between the housing 28 and a guide shaft 78 rigidly secured at its upper end to the piston 31 having a threading at its lower end. The piston 31 and the guide shaft 78 function in the same way as the plunger 5 described above. Reset springs 36, for example in the form of a package of Belleville springs; are inserted between the bottom 86 of the bore 79 and a washer 80 held in place by a nut 81 on the threaded end 78' of the guide shaft 78. Thus, normally the springs 36 tend to hold the piston 31 against the shoulder 37. The pressure applied through the port 35 must overcome the biasing force of the springs 36. The excess force tending to push the piston 31 and thus the roller head 30 upwardly must be equal to the force exerted by the fluid under pressure admitted through the port 33 to the hydrostatic bearing 3. This equilibrium is necessary to make the hydrostatic bearing 3 operational and to exert the desired rolling force.

Figure 6:
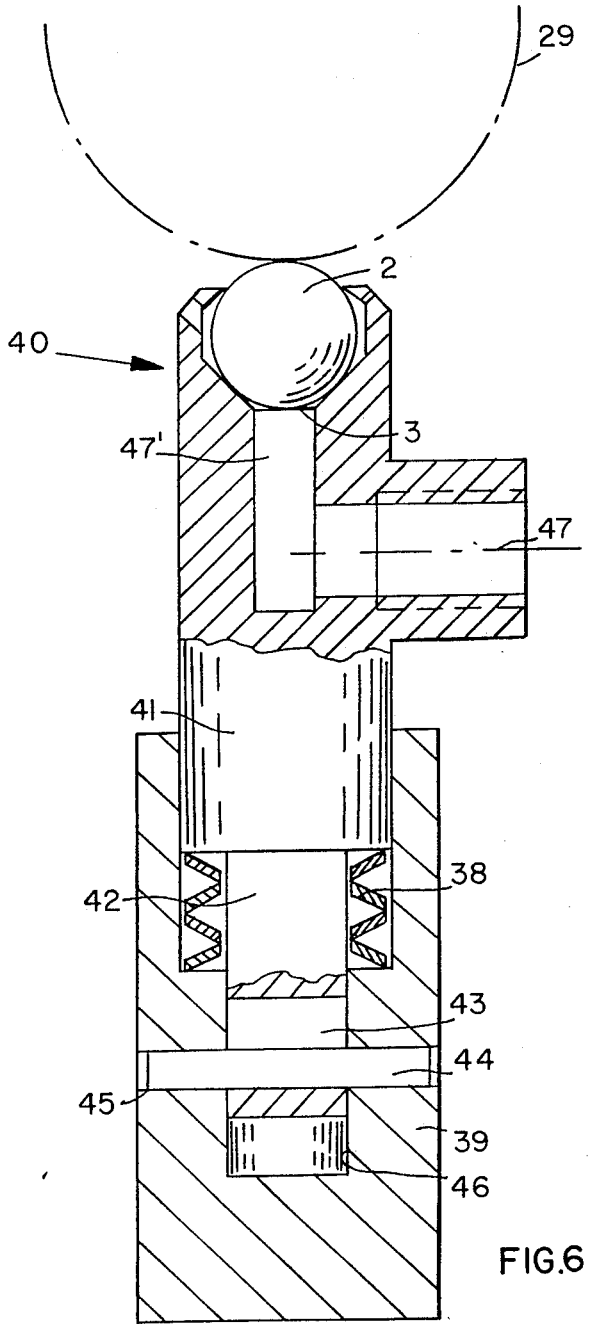
FIG. 6 shows a sectional view through a further modification of a burnishing and deep rolling tool according to the invention.

FIG. 6 illustrates a rolling tool similar to that of FIG. 5. A roller head 40 has a lower guide piston end 41 received in a bore of the housing 39. The lower portion of the piston end 41 is formed as a guide shaft 42 passing through spring means 38 into a guide bore 46 in the housing 39. The spring means 38, for example in the form of a set of Belleville springs or in the form of rod springs or helical springs, bear against the downwardly facing surface of the piston end 41 of the roller head 40. The spring means 38 are so dimensioned that they tend to push the roller head 40 upwardly toward a work piece surface 29, whereby the upward displacement of the roller head 40 is limited by a pin 44 inserted in a bore 45 passing through the housing 39 and through an elongated hole 43 in the lower end of the guide shaft 42. Thus, the piston end 41 of the roller head 40 is axially displaceable within the housing 39 and within the stop limits defined by the elongated hole 43. In operation the housing 39 is received in a chuck which positions the milling roller 2 against the surface 29 of a work piece. The applied rolling force is determined by the spring means 38. When the rolling force is applied to the housing 39 through the chuck, the roller head 40 is displaced against the force of the spring means 38 relative to the housing 39. Simultaneously with the application of the rolling force, the hydrostatic bearing 3 is supplied with fluid under pressure through the inlet port 47 and duct 47'. During the rolling operation, the force of the springs 38 must be equal to the force applied by the fluid under pressure to the hydrostatic bearing to provide the required equilibrium for the application of the rolling force. Incidentally, any type of spring suitable for permitting relative movement between the roller head 40 and the housing 39 is suitable for the present purpose.

Figure 7:
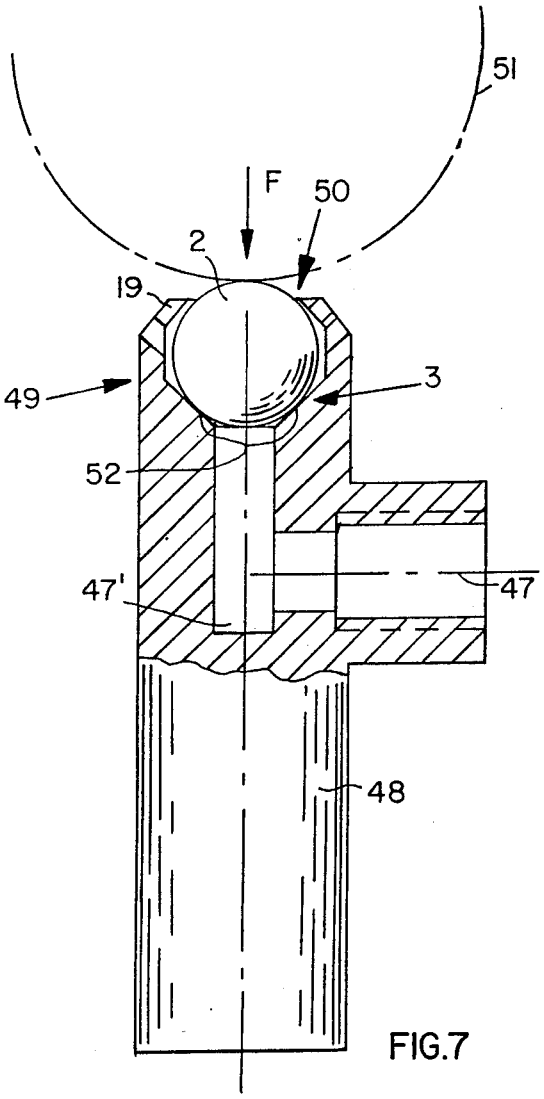
FIG. 7 and 7*a* show a partial longitudinal section of a substantially simplified burnishing and deep rolling tool of the invention.
Figure 7A:
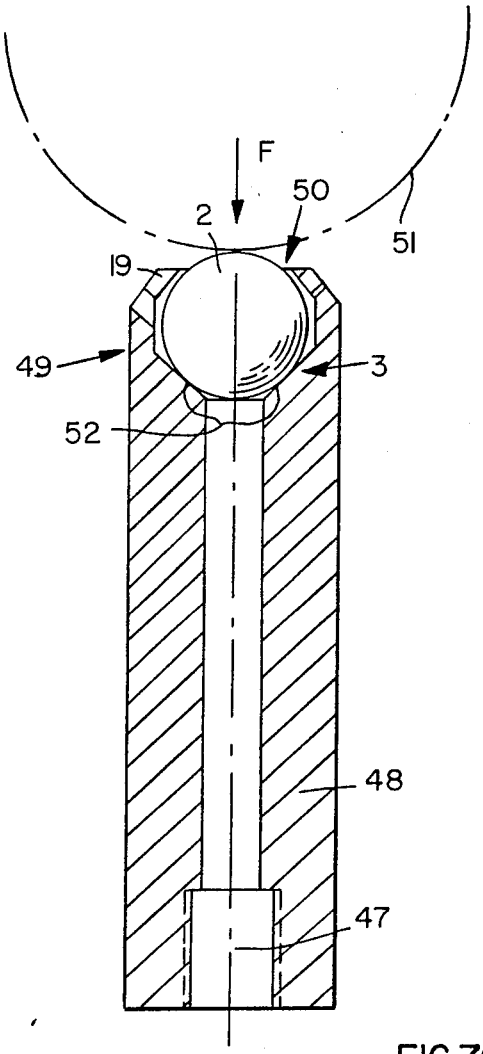

FIG. 7 illustrates an especially simple embodiment according to the invention. The chucking or clamping shaft 48 forms simultaneously the roller head 49 as a structural integral unit so that a relative motion between the two is not possible. If the chucking device holding the chucking shaft 48 does not permit any radial movement, that is a movement radially toward the work piece 51 along the longitudinal axis of the tool, the total radial displacement is determined by the play 50 between the milling roller 2 and the retaining rim 19. When the milling roller 2 is moved against the work piece 51 the milling roller 2 must be so positioned that it contacts the surface of the work piece 51 while still maintaining the necessary play between the milling roller 2 and the components of the hydrostatic bearing 3 including the retaining rim 19. If now, fluid under pressure is supplied through the inlet port 47 and the duct 47' into a bearing chamber 52, the hydrostatic bearing 3 is activated and the milling roller 2 is pressed against the work piece for producing the required rolling force.

FIG. *7a* shows a modification of the embodiment shown in FIG. 7, whereby the only difference between the two embodiments is the location of the inlet port 47. In FIG. *7a* that inlet port 47 is located at the lower end of the chucking or mounting shaft 48.

Figure 8:
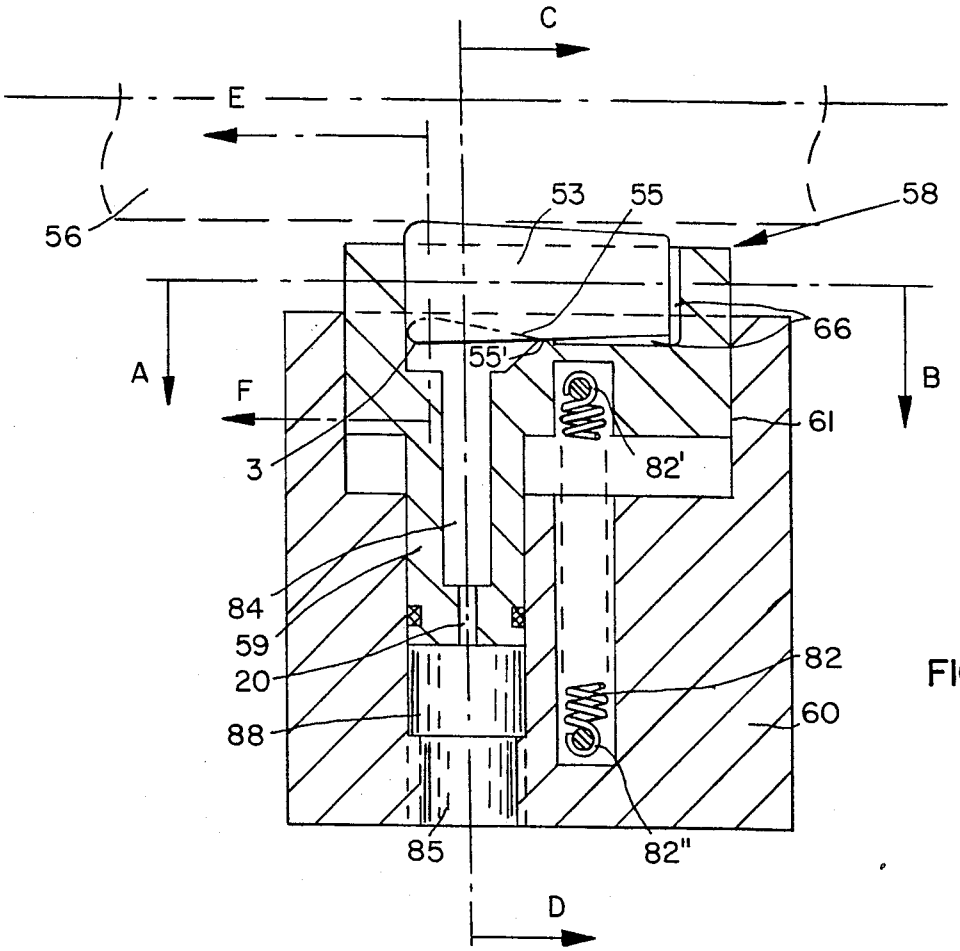
FIG. 8 is a longitudinal section with the section plane passing through the milling roller axis.

FIG. 8 shows an embodiment in which the rolling tool proper is constructed as a roller 53 hydrostatically guided in a roller head 58. The roller head in turn is guided in a slideable manner in a pocket or recess 61 of a housing 60. A reset spring 82 constructed as a tensile spring is connected at its upper end 82' to the roller head 58 and at its lower end 82" to the housing 60. The roller head 58 also comprises a guide plunger 59 extending downwardly into a guide bore 88 of the housing 60 for guiding the up and down movement of the roller head 58. The guide plunger or piston end 59 of the roller head 58 comprises a fluid duct 84, the lower end of which is closed except for a throttling bore 20 for supplying fluid under pressure to the hydrostatic bearing 3. Fluid under pressure is supplied to the bore 88 through the inlet port 85.

Figure 11:
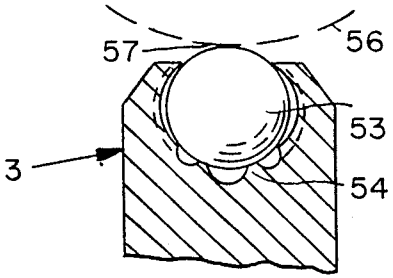
FIG. 11 is a sectional view along section line E–F in FIG. 8.
Figure 9:
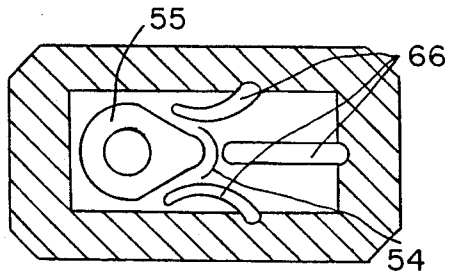
FIG. 9 is a sectional view along section line A–B in FIG. 8, however, omitting the milling roller.
Figure 10:
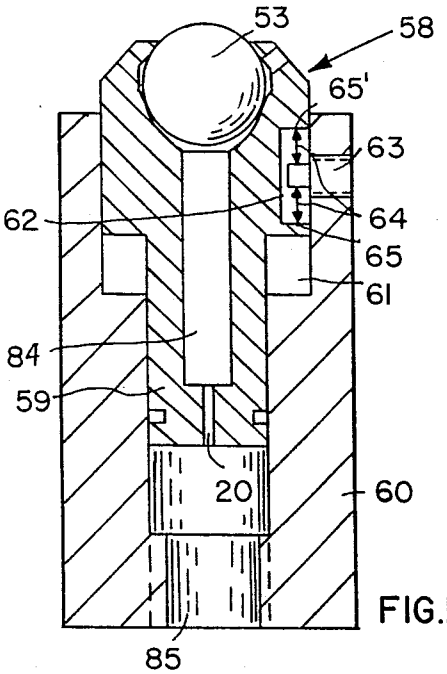
FIG. 10 is a sectional view along section line C–D in FIG. 8.

FIGS. 9, 10, and 11 show sectional views through FIG. 8, whereby FIGS. 9 and 11 show the construction of the hydrostatic bearing for the milling roller 53. A bearing shell 54 is formed in the roller head 58. The bearing shell 54 has the shape 55 best seen in FIG. 9. A fluid pressure is established in the bearing shell 54 to carry or support the milling roller 53. Any overflowing fluid is discharged through relief channels 66. After the milling roller 53 has contacted the surface of the work piece 56, the rolling force is transmitted through the contact surface or interface 57 between the work piece 56 and the milling roller 53. The pressure established by the fluid in the hydrostatic bearing maintains an equilibrium with the rolling force. If this equilibrium is not established, then the surface of the milling roller 53 would bear against the upper edge 55' of the shell shape 55. As long as the equilibrium is maintained, the milling roller 53 does not bear against the upper edge 55' so that a small throttle gap is maintained through which fluid can pass to the relief channels 66. It is advantageous to make the shell shape 55 with such a configuration that it conforms to the contact surface 57 between the milling roller 53 and the work piece 56.

FIG. 10 is a section along section line C–D in FIG. 8 and shows a stroke limiting feature in the roller head 58. For this purpose the roller head 58 is provided with a groove 62 into which a threaded pin 63 reaches. The threaded pin 63 is received in a threaded hole in the housing 60 in such a position that the inner end of the pin 63 provides about equal stroke portions 64 in the upward and downward directions to permit the respective movement of the roller head until either the shoulder 65 or the shoulder 65' of the roller head 58 contact the inner end of the pin 63.

Figure 12:
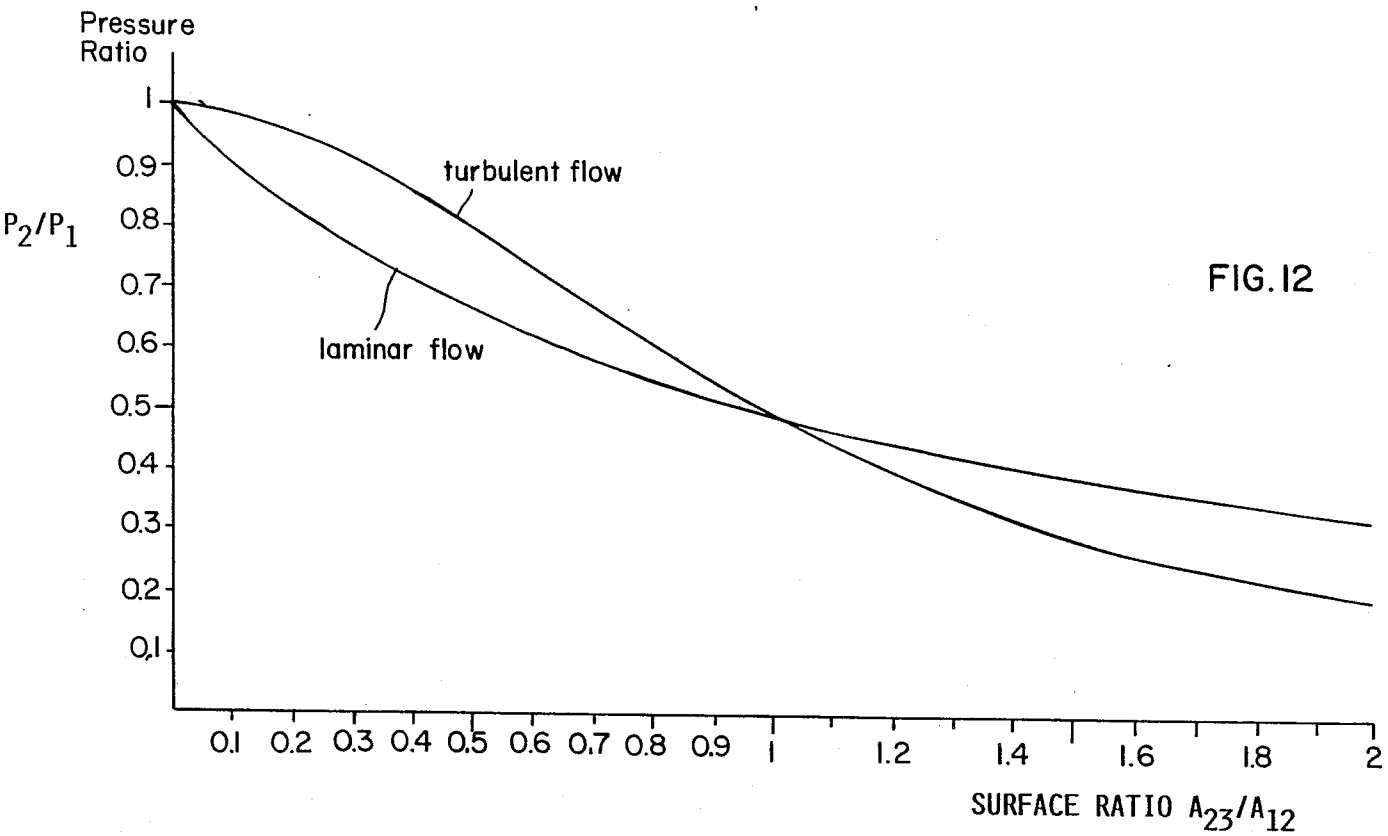
FIG. 12 is a diagram showing the compression ratio P2/P1 as a function of the surface or area ratios $A_{23}/A_{12}$.

FIG. 12 shows a diagram illustrating the characteristic of a laminar flow and that of a turbulent flow in the hydrostatic bearing, whereby the ordinate shows the pressure ration P2/P1 of the entrance pressure P1 upstream of the throttling device to the pressure P2 downstream of the throttling device, namely in the hydrostatic bearing, whereas the abscissa shows the ratio of the respective throttling surfaces $A_{23}/A_{12}$.

The sequence of a smooth rolling operation will now be described with reference to FIG. 3. The housing 1 holding the roller head 4 is chucked in the tool support such as a revolver head of a lathe not shown. A work piece 11 is clamped in the chuck of the lathe and the chuck drive is switched on to cause rotation of the work piece 11. The tool with the milling roller is advanced by the tool carrier or support to such an extent that the spacing between the surface of the section to be smooth rolled, and the surface of the milling roller 2 corresponds to about one half of the roller head stroke 64. Fluid under pressure P1 is now admitted through the inlet port 6 into chamber 22 upstream of the throttling bore. The fluid flows through the throttling bore 20 into the channel 8 and establishes the pressure P2 in the hydrostatic bearing 3 from which excess fluid can pass through the throttling device 21, thereby activating the hydrostatic bearing 3. As a result, the roller head 4 is moved or pushed by the fluid pressure toward the work piece 11, whereby the milling roller 2 is pressed against the work piece 11. The milling roller 2 now rotates as a result of the rotation of the work piece. The longitudinal feed advance of the tool support in the lathe can now be started to perform the rolling operation in the normal manner. If the section of the work piece 11 to be smooth rolled, does not conform to a cylindrical shape, the roller head 4 may be guided so as to follow any deviations of the cylindrical form to keep the milling roller 2 in contact with the surface to be smooth rolled. If the inlet pressure P1 is reduced below the working pressure P2, the roller head 4 will be pulled back from the work piece 11 by the reset spring 18.

FIGS. 13 to 16 illustrate a simple burnishing and deep rolling tool according to the invention, corresponding substantially to the embodiment described above with reference to FIGS. 7 or *7a*. The modification in FIGS. 13 to 16 resides in the structural features of the hydrostatic bearing itself. The hydrostatic bearing is constructed to permit a relative large stroke of the milling roller itself. As a result, the tool of FIGS. 13 to 16 is especially suitable for compensating relatively large tolerances in the dimensions of the work piece 11. This compensation is accomplished without unduly or adversely affecting the rolling or milling force. This advantage is possible with the embodiment of FIGS. 13 to 16 because the throttling gap 95 between the roller 2 and the walls 99 of the roller guide chamber 90 remains substantially constant through most of the stroke motion of the roller 2, except in the outer end position.

Thus, the rolling force remains substantially constant until the milling roller 2 reaches its upper end position in the hydrostatic bearing.

The tool according to FIGS. 13 to 16 comprises substantially a tool of the type shown in FIG. 7, having a chucking shaft 48 with an inlet port 47 for fluid under pressure. A connecting channel 92 communicates the chamber 90 of the hydrostatic bearing with the inlet port 47. The channel 92 has a cross-sectional flow area 93. The chamber 90 is constructed as a cylinder 91, whereby the roller 2 is a spherical ball having a ball diameter of such a size that the throttling gap 95 is formed between the ball surface and the walls 99 of the cylinder chamber 91. Toward the upper end of the cylinder chamber 91 there is provided a widening section 101 followed by a narrowing section 103, the diameter of which reduces toward the upper edge to form the ball retaining rim 19 having an inwardly slanting surface 102. The retaining rim 19 forms an outwardly open cross-section 104 which is smaller than the cross-section 105 of the cylindrical guide chamber 90, 91. Relief bores 12 for fluid passing through the throttling gap 95 are provided in the section 101 or 102. These relief bores 12 are distributed around the entire rim 19, preferably a uniform spacing.

As mentioned, the construction of the roller head 106 permits a substantial stroke of the roller sphere 2 in the stroke direction indicated by the double arrow 98. This freedom of movement is indicated at 96 in FIG. 16. The lower position of the milling roller 2 is indicated by the central axis 89. In this position the surface of the milling roller 2 is just about in tangential contact with the surface of the outwardly open cross-section 104. In order to assume a safe rolling position or in order to compensate for dimensional tolerances or configuration tolerances of the work piece 11, the milling roller 2 can assume the position in which the central axis moves to 89', whereby milling the roller is displaced by the distance 96 in the outward direction without changing the throttling gap 95. As a result, the milling roller 2 can move by a substantial distance radially outwardly, or axially outwardly without any simultaneous reduction of the rolling force. Only when the mentioned position is exceeded, for example because the rolling operation is completed, and the work piece surface is no longer in contact with the milling roller surface, it becomes possible for the milling roller 2 to further travel outwardly as shown in FIG. 15. However, even in this position the milling roller 2 is still held by the rim 19 although an open ring gap or cross-section 94 is formed as shown in FIG. 15. The ring gap 94 is substantially larger than the throttling gap 95 so that at this point fluid under pressure can escape in larger quantities through the relief channels 12. In this condition, the milling roller 12 is held in place with a relatively small force until the milling roller is again pressed against a work piece to be smoothed. The retreating movement of the milling roller takes place until the throttling gap 95 is again established for generating the required milling or rolling force.

Figure 17:
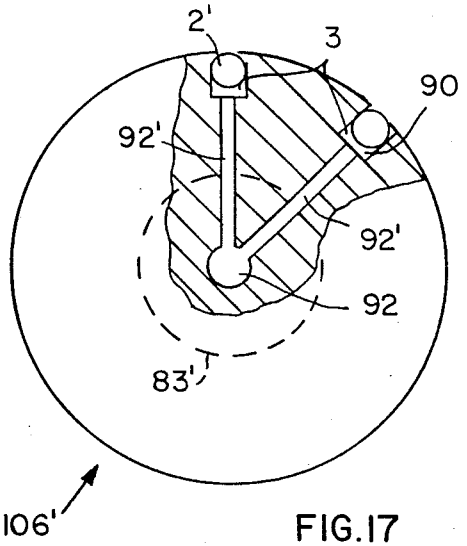
FIG. 17 shows a front view of a burnishing and deep rolling tool in the direction of the longitudinal tool axis and carrying a plurality of rolling spheres for smooth rolling of bores.
Figure 18:
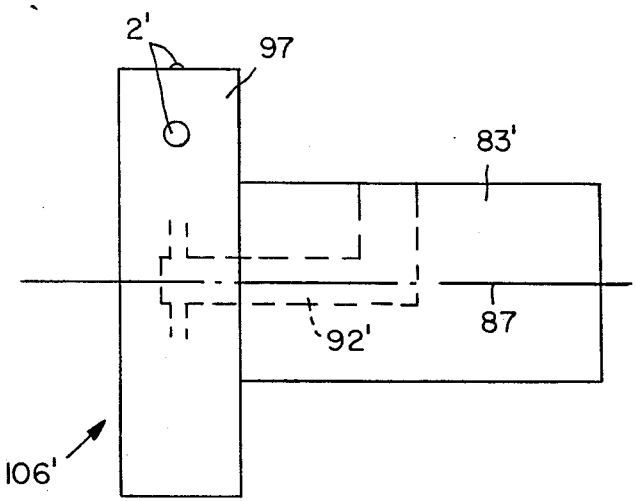
FIG. 18 is a side view of the tool embodiment according to FIG. 17.

FIGS. 17 and 18 show another embodiment of the invention in which a plurality of rollers, such as spheres 2' are held in a multiple roller head 106'. The roller head 106' comprises a plurality of hydrostatic bearings 3' with bearing chambers 90. Each of these chambers holds its own roller 2' in the same manner as described above with reference to FIGS. 13 to 16. Preferably, the roller chambers 90 are uniformly distributed around or along the circumference of the roller head 106', whereby the sector angles between neighboring fluid supply ducts 92' would be equal to each other. The roller head 106' comprises a cylindrical base body 97. As shown, the milling rollers 2' face radially outwardly. However, the base body 97 could also be constructed as a hollow ring body with the rollers facing radially inwardly to thereby surround a work piece to be rolled. In both embodiments, all guide chambers 90 would be connected to a common fluid pressure supply channel 92 from which the individual ducts 92' branch off. The tool shown in FIGS. 17 and 18 could be inserted into the bore of a cylinder for smooth rolling the inner cylinder wall. On the other hand, when the tool is constructed as a ring body, a cylindrical shaft could be surrounded by the present milling tool.

The milling rollers or spheres 2' may be exposed to pressure even before entry of the tool into the bore of a work piece. As a result, the inwardly facing wall of the bore to be smooth rolled will press the milling rollers 2' radially inwardly to such an extent that the required pressure and thus the respective milling or rolling force will be established through the supply of fluid under pressure or other suitable pressure supply means. Either the tool or the work piece or both may be rotated during the insertion or the rotation may only be started when the milling rollers 2' contact the surface of the work piece. An unpermissible or undesirable displacement of the roller head 106' in one direction only is not likely because the rollers 2' would enter into the widened zone 101 as shown in FIGS. 15 and 16 so that the resulting gap 94 would substantially eliminate any rolling force. As a result, the roller head 106' would again automatically center itself into the proper position.

The roller head 106' may also be provided with a chucking shaft 83' for rotation about its central axis 87. However, other mounting means for the body 97 are also suitable.

A tool according to the invention with its hydrostatically guided milling roller has a plurality of advantages. The tool can be rather compact, thereby making it possible to mount the tool, in the same manner as any known chip removing tool, e.g. in a revolver head of respective machines e.g. lathes. These tools may be retained in such a position on the revolver head. The tool can be applied to the work piece while the latter is moving or rotating so that the stopping of the work piece that was necessary heretofore for contacting the work piece surface with the roller of the burnishing and deep rolling tool is no longer necessary. Simultaneously, the milling rollers have a substantially higher useful life than was possible heretofore, because pitting is avoided, since the heretofore required cooperation of the rollers with support rollers is avoided according to the invention. The prolonged useful life of the present rollers is further improved by the use of ceramic materials for making these milling rollers.

The construction of the guide chambers 90, 91 for the milling rollers as described with reference to FIGS. 13 to 16 further improve the hydrostatic bearings substantially, thereby making it possible to provide increased stroke motions for the milling rollers so that yielding motions of these milling rollers are also possible without any appreciable change in the rolling force.

Although the invention has been described with reference to specific example embodiments, it will be appreciated that it is intended to cover all modifications and equivalents within the scope of the appended claims.

I claim:

1. A burnishing and deep rolling tool, comprising roller means for performing a rolling operation, roller head means including a hydrostatic bearing socket for rotatably supporting, guiding and holding said roller means, said hydrostatic bearing socket forming a hydrostatic bearing for said roller means, fluid duct means leading into said hydrostatic bearing for connecting said hydrostatic bearing to a source of pressurized fluid, and wherein said hydrostatic bearing socket comprises a chamber for each of said roller means, said chamber having a chamber diameter widening section, a chamber diameter reducing section forming a rim (19) for retaining said roller means, said rim extending around an axially outer end of said hydrostatic bearing socket, and pressure relief means (12, 66) leading into said chamber diameter widening section in said hydrostatic bearing socket for an effective pressure relief on said roller means when said roller means clears a contact with said hydrostatic bearing socket.

2. The tool of claim 1, wherein said roller head means comprise a shaft for holding said burnishing and deep rolling tool.

3. The tool of claim 2, wherein said holding shaft is constructed for chucking the holding shaft in a machine tool chuck.

4. The tool of claim 2, further comprising tool housing means having a guide bore therein for slideably receiving said holding shaft in said guide bore.

5. The tool of claim 4, wherein said housing means are constructed for chucking the housing means in a machine tool chuck.

6. The tool of claim 4, further comprising clamping shaft means (83) for holding said tool housing means in a machine tool.

7. The tool of claim 4, further comprising spaced stop means in said housing means for defining a guide stroke for said holding shaft.

8. The tool of claim 1, further comprising housing means including a cylinder bore for holding said roller head means, said roller head means comprising a plunger section received in said cylinder bore of said housing means.

9. The tool of claim 8, wherein said cylinder bore forms a guide bore for said plunger section, said plunger section comprising a piston formed as a disk guided in said guide bore of said housing means, said guided disk having at least one through-flow bore for fluid under pressure.

10. The tool of claim 8, wherein said fluid duct means are arranged in said plunger section and in said roller head means.

11. The tool of claim 10, wherein said fluid duct means have an opening for connection to a source of fluid under pressure, said opening being preferably located at an end of said duct means opposite said roller means.

12. The tool of claim 11, wherein said housing means comprise an inlet port leading to said cylinder bore for connecting said cylinder bore to a source of fluid under pressure, said cylinder bore communicating with said duct means.

13. The tool of claim 11, wherein said housing means comprise an inlet port leading to said cylinder bore for connecting said cylinder bore to a source of fluid under pressure, and wherein said duct means comprise a closure member for closing said duct means to said cylinder bore and throttling means in said closure member for restricting fluid flow into said duct means.

14. The tool of claim 8, further comprising at least one reset spring arranged for normally urging or biasing said plunger section and said roller head means into a predetermined position.

15. The tool of claim 14, wherein said reset spring is constructed as a compression spring, one end of said compression spring resting against said housing means, the other end of said spring resting against said plunger section of said roller head means.

16. The tool of claim 15, wherein said compression spring is a helical spring surrounding said plunger section, said plunger section having a guide piston (15) at its free end, said helical spring bearing against said guide piston of said plunger section and against said housing means.

17. The tool of claim 14, wherein said compression spring comprises a package of Belleville springs.

18. The tool of claim 8, wherein said plunger section comprises a guide bolt extending coaxially from said plunger section opposite said roller means, said housing means having a guide bore in which said guide bolt is a slideably received for an axial movement, said housing means having a further bore larger in diameter than said guide bore at an end opposite said roller means, said guide bolt having a threaded end, reset spring means surrounding said guide bolt in said larger diameter bore, a washer on said guide bolt for supporting said reset spring means between said housing means and said washer, and a nut on said threaded end of said guide bolt, said washer resting against said nut for holding said reset spring means in place and for adjusting a biasing force of said reset spring means.

19. The tool of claim 8, further comprising reset spring means constructed as tensile spring means connected at one end to said roller head means and at the other end to said housing means.

20. The tool of claim 8, wherein said hydrostatic bearing has a first effective compression application surface, wherein said plunger section has a second effective compression application surface, said first and second surfaces being equal to each other in size.

21. The tool of claim 1, further comprising adjustable throttle means in said fluid duct means for supplying fluid under pressure to said hydrostatic bearing through said adjustable throttle means.

22. The tool of claim 1, wherein said chamber formed by said hydrostatic bearing socket constitutes a guide chamber for each roller means, said guide chamber having chamber walls extending in parallel to each other and in a stroke direction of said roller means, said chamber walls extending substantially tangentially tot he respective roller means, a throttling gap between each chamber wall and the respective surface of said roller means, said chamber walls forming said chamber diameter widening section (101) followed by said chamber diameter reducing section (103) forming said roller means retaining rim (19) through which said roller means can extend out of said guide chamber for a limited extent for applying a rolling force to a work piece, said retaining rim having an open cross-section which is smaller than a cross-section of said guide chamber.

23. The tool of claim 22, wherein said pressure relief means lead into said guide chamber in a zone defined by said chamber diameter widening section and said chamber diameter reducing section in such a position that pressure relief is assured when said roller means clears a contact with said hydrostatic bearing socket.

24. The tool of claim 22, comprising a base body and a plurality of said guide chambers operatively arranged in said base body, each guide chamber holding one roller means, whereby said base body forms said roller head means capable of holding a plurality of roller means.

25. The tool of claim 24, wherein said base body has a head portion having an approximately circular configuration.

26. The tool of claim 25, wherein said guide chambers are uniformly distributed around said head portion.

27. The tool of claim 1, wherein said roller means are made of a ceramic material.

* * * * *